US008109456B2

(12) United States Patent
Christensen

(10) Patent No.: US 8,109,456 B2
(45) Date of Patent: Feb. 7, 2012

(54) SYSTEM TO ACCELERATE STABILIZATION OF DRILL CUTTINGS

(75) Inventor: Matheus Christensen, Sogne (NO)

(73) Assignee: Advanced Cuttings Treatment AS, Sogne (NO)

( * ) Notice: Subject to any disclaimer, the term of this patent is extended or adjusted under 35 U.S.C. 154(b) by 132 days.

(21) Appl. No.: 12/596,380

(22) PCT Filed: Apr. 15, 2008

(86) PCT No.: PCT/NO2008/000134

§ 371 (c)(1),
(2), (4) Date: Oct. 16, 2009

(87) PCT Pub. No.: WO2008/127123

PCT Pub. Date: Oct. 23, 2008

(65) Prior Publication Data

US 2010/0133368 A1 Jun. 3, 2010

(30) Foreign Application Priority Data

Apr. 16, 2007 (NO) ..... 20071910

(51) Int. Cl.
*B02C 18/00* (2006.01)

(52) U.S. Cl. ..... 241/65; 241/101.8; 241/152.2

(58) Field of Classification Search ..... 241/65, 241/101.8, 152.2

See application file for complete search history.

(56) References Cited

U.S. PATENT DOCUMENTS

| | | | | |
|---|---|---|---|---|
| 4,880,468 | A | 11/1989 | Bowlin et al. | |
| 5,361,998 | A * | 11/1994 | Sirevag et al. | 241/79.1 |
| 6,045,070 | A * | 4/2000 | Davenport | 241/60 |
| 2004/0139866 | A1 | 7/2004 | Lopez | |

FOREIGN PATENT DOCUMENTS

| | | | |
|---|---|---|---|
| DE | 39 39 513 | A1 | 6/1991 |
| RU | 2097526 | C1 | 11/1997 |
| RU | 2145580 | C1 | 2/2000 |
| WO | WO-2007/102743 | A1 | 9/2007 |

* cited by examiner

*Primary Examiner* — Faye Francis

(74) *Attorney, Agent, or Firm* — Birch, Stewart, Kolasch & Birch, LLP

(57) ABSTRACT

An integrated unit (1) for the treatment of drill cuttings, comprising one or more drill cutting inlets (2), one or more water inlets (4), one or more binder inlets (3) and one or more additive inlets (6). One or more measuring devices are arranged for measuring the composition of the drill cuttings furnished to the unit. One or more dosage units are arranged for furnishing the required amount of binder or additive respectively. The device further comprises a mixing (7) unit arranged for mixing the compounds and a first granulation unit (8) for milling, granulating, setting and hardening the mixture. The invention further describes a method for the treatment of drill cuttings and the use of an integrated unit on an off-shore drilling unit.

4 Claims, 2 Drawing Sheets

SYSTEM TO ACCELERATE STABILIZATION OF DRILL CUTTINGS

INTRODUCTION

When drilling for petroleum or other resources a large amount of drill cuttings result from the drilling. These cuttings are often considered to be toxic or environmentally hazardous, either by the cuttings themselves comprising toxic compounds or by the cuttings having been contaminated either by contact with drilling fluids such as mud, or by contact with the petroleum products as such. Given the toxicity of the compounds an adequate disposal means for the cuttings must be found, such that the cuttings no longer represent an environmental hazard.

A particular problem arises when drilling off-shore as the handling of cuttings has previously mainly been done on land. Space is at a premium on off-shore installations, thus large scale handling of cuttings has been prohibitively expensive. Bagging and later shipping of the cuttings for treatment on land has been the preferred treatment method for the cuttings. Furthermore the cuttings have usually been incinerated on shore resulting in large scale emissions of $CO_2$ and the need for treatment of the waste which often may comprise heavy metals or the like.

The present invention seeks to overcome at least some of the above problems, and comprises a new method for the handling and treatment of cuttings. The method and the device for implementing same may treat all variants of cuttings, and allows an environmentally friendly treatment of cuttings, specially adapted for being implemented off-shore. One may consider the method to be an accelerated hydration and hardening process.

BACKGROUND ART

There are in existence today a large number of drill cutting handling units.

NO164219 presents a plurality of operations being performed on mud having been used in drilling operations. A large number of operations are performed in several stages in a plurality of devices. The drill cuttings are not treated.

NO315808 shows a method for the thermal treatment of drill cuttings.

NO172217 shows a milling device for drill cuttings wherein drill cuttings are milled until a desired particle size has been obtained. No stabilization of the cuttings is described.

DE3939513 describes the addition of a cement directly to a mud and cuttings mixture for the stabilization of sludge lagoons and the like. The lagoons are to be situated on-shore and be lined excavated pits which may later be covered by soil for the cultivation of plants. The method necessitates transporting the mud to shore, and there is the risk of leakage of heavy metals from the sludge which is why the pits must be lined.

U.S. Pat. No. 6,706,108 describes a method for production of road base material by adding pozzolanic or hydrating materials to a sludge in a cold batch process. The process takes place on-shore.

U.S. Pat. No. 6,585,115 shows a process for the treatment of cuttings, wherein the process describes drying and storage of the cuttings prior to reinjection or shipping to shore. No milling or crushing is described.

US2005/0153844 describes a method for the thermal treatment of cuttings. The process results in dry cuttings which may be handled more easily. No milling or further treatment is described.

U.S. Pat. No. 6,322,489 describes a method for the treatment and handling of cuttings wherein liquids are separated from the cuttings and the cuttings are stabilised for use in marshlands. The step wherein liquids are separated is quite costly, and not adapted for use off-shore.

U.S. Pat. No. 4,880,468 describes a method for the solidification of a waste, said waste comprising mainly mud and drill cuttings. No milling and admixture of further compounds are described.

Although there is mention of the various treatment methods of the present invention in the documents, none of them propose a single unit capable of treating drill cuttings directly and allowing them to be released to the environment without risk of leakage of potentially harmful materials.

SHORT SUMMARY OF THE INVENTION

The present invention seeks to overcome at least some of the above-mentioned shortcomings and describes an integrated unit for the treatment of drill cuttings, said device comprising one or more drill cutting inlets, one or more water inlets, one or more binder inlets and one or more additive inlets. One or more measuring devices arranged for measuring the composition of the drill cuttings furnished to the unit. One or more dosage units are arranged at said one or more inlets, said dosage units being arranged for furnishing the required amount of binder or additive respectively. The device further comprises a mixing unit arranged for mixing the compounds, whereto a mixing outlet is connected, said mixing outlet arranged for feeding the mixture to a first granulation unit, said first granulation unit arranged for milling, granulating, setting and hardening the mixture. Said first granulation unit is further arranged for transportation of the set, hardened and granulated mixture to a storage tank.

The invention further describes a method for the treatment of drill cuttings said method comprises the following steps feeding drill cuttings to a mixing unit in an integrated unit, measuring the composition of the drill cuttings, feeding binder material, water, steam and/or additives to said mixing unit according to the composition of said drill cuttings, mixing said drill cuttings and added materials within said mixing chamber to form a mixture, feeding said mixture through a mixing outlet to a granulation unit, granulating, setting and hardening said mixture in said granulation unit, transporting said set and hardened granulated mixture to an outlet for storage or disposal of said set and hardened granulated mixture.

The invention further discloses the use of an integrated unit as described on an off-shore drilling unit.

Further advantageous embodiments of the invention are defined in the dependent claims herein enclosed.

FIGURE CAPTIONS

The present invention will be described referring to the figures.

EMBODIMENTS ACCORDING TO THE INVENTION

Figure 1:
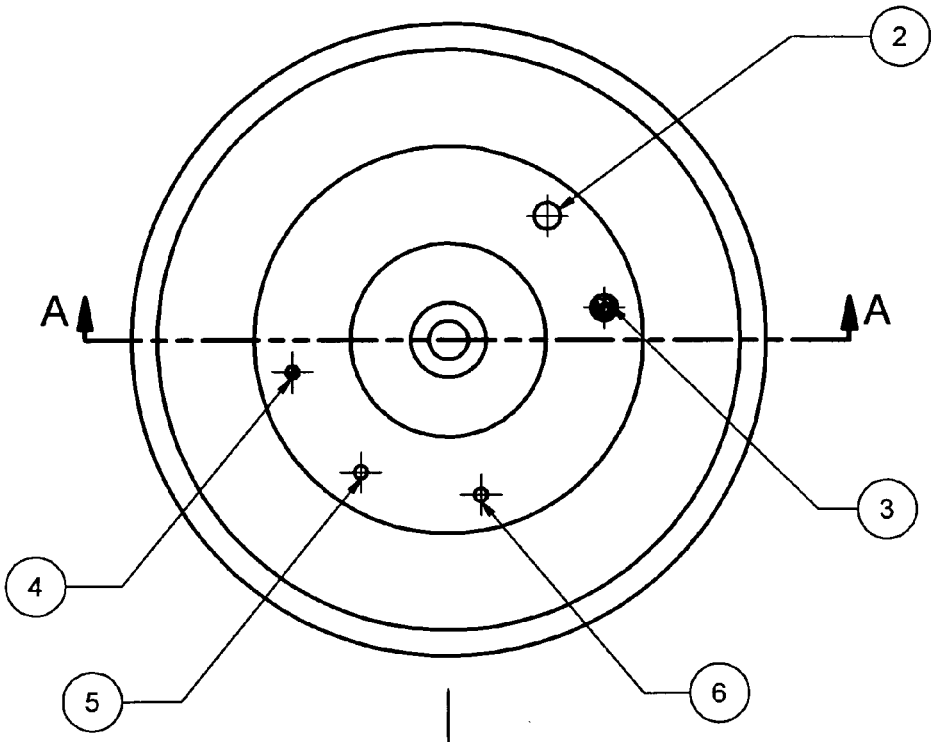
FIG. 1 shows a top view of the device according to the invention.

The invention will be described referring to the figures. Although exemplary embodiments of the invention have been presented, obvious variants not having been described should be considered as lying within the scope of the invention.

The present invention describes a compact integrated unit (1) for the treatment of drill cuttings resulting from drilling activities off-shore. The drill cuttings are initially separated from the mud using a mud sieve, and furnished to a storage tank usually present at the off-shore installation. The drill cuttings will often be polluted by mud of various kinds according to drilling performed. Mud may be classified as being oil-based, synthetic oil-based or water based, or combinations thereof, each presenting different environmental challenges.

The integrated unit (1) according to the invention is provided with a drill cutting inlet (2) for furnishing of the drill cuttings to a mixing chamber (7). The composition of the drill cuttings furnished to the unit (1) is measured, and required binder material is furnished through a binder inlet (6). The binder may comprise pozzolanic materials such as cement, wherein the cement is arranged for binding and stabilizing the drill cuttings and the chemicals adhering thereto. The amount of binder material to be added will depend on the water content of the drill cuttings, as well as on the chemical composition of the cuttings.

According to an embodiment of the invention, a first milling unit (9) may be arranged at the mixing outlet (10), such that the mixture may be milled before being furnished to said first granulation unit (8). The mixing outlet (10) may be arranged for the vibration furnishing of the mixture such that mixture is furnished in a controlled manner to the first granulation unit (8). The device may thus function according to an accelerated hydration and hardening process.

In an embodiment of the invention, heated vapours and/or heated water may be added to the process in order for accelerating the setting and hardening process. Water inlets (4) and or vapour inlets (5) are in an embodiment of the invention arranged in communication with the mixing chamber (7) for the furnishing of hot water and/or hot vapours. Please refer to FIG. 1.

An advantage of providing vapour or hot gases to the mixture is that the drill cuttings when they arrive on the drilling unit, are quite cool at temperatures often about 60° C. Although the downhole formation temperature may be about 170° C. or higher, there is a degree of cooling of the mud and drill cutting mixture as the mixture is transported to surface. This is due to heat exchange with the cool sea water surrounding the pipe. It is an advantage to increase the temperature of the mixture to a large degree, up to about 100° C. or more upon treatment in the integrated unit (1). This allows the further reduction in the size of the integrated device (1), and a reduced residence time within the integrated unit (1).

In an embodiment of the invention, a first intermediate storage area (12) may be arranged after an outlet (10) from the mixing unit (7). This will allow the mixture to begin setting and hardening before granulation. In an embodiment of the invention the hot vapour is furnished to the first intermediate storage area (12)

The vapours may be any kind of hot gas which does not interfere with the setting and hardening process, in an embodiment of the invention the hot gas mainly comprises steam.

After mixing the within the mixing chamber (7) the mixture will be furnished to a first granulation unit (8) for granulation, setting and hardening. The first granulation unit (8) will serve to granulate, set and harden the mixture furnished thereto.

When furnishing material to the first granulation unit (8) a first milling and crushing system (9) may be arranged prior to the outlet from the mixing chamber (7), such that additional crushing and milling is performed before the first granulation, setting and hardening process.

Figure 2:
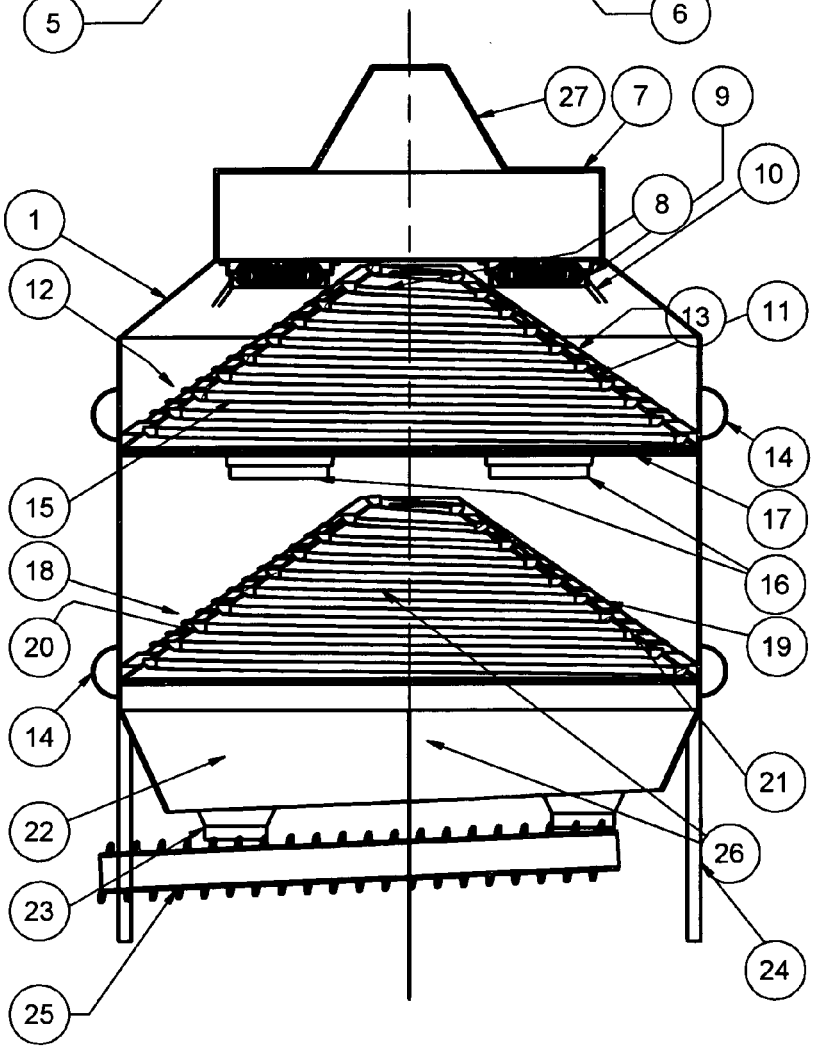
FIG. 2 shows a cross-section of the device according to the invention along the lines A-A of FIG. 1.

In an embodiment of the invention, the first granulation unit (8) is formed as a conically upwardly tapered unit, wherein a first helix transportation slit (11) is arranged on the surface of the granulation unit (8). In this embodiment of the invention, the mixture from the mixing tank (7) is furnished to an outer lower section of the first granulation unit (8), whereupon the mixture is transported in an upwards direction by the rotation of the first granulation unit (8). The mixture will be granulated by the contact with the internal cover (13) surrounding the first granulation unit (8). This is illustrated in FIG. 2. In this embodiment of the invention, the mixture will be set, hardened and granulated along the path of the first helix shaped transportation slit (11) until it reaches the upper portion of the granulation unit. At the upper portion of the granulation unit there is arranged an aperture through which the set, hardened and granulated mixture may enter into an internal cavity of the first granulation unit (8). This internal cavity is shown as a first storage tank (15) in FIG. 2.

In an embodiment of the invention said helix shaped transportation slit (11) may have an adjustable angle with respect to the vertical axis, such that the granulate size may be controlled. The helix shaped transportation slit (11) may be further provided with outer edges for the containment of the material in the helix transportation slit (11) and to prevent overflow from the slit (11).

In an embodiment of the invention there may be arranged a rotating disc internally within the first storage tank (15). This rotating disc is arranged for mixing and activating the granulate for further setting and hardening of same.

In an embodiment of the invention a second granulation unit (20) is arranged in communication with the first storage tank (15). This second granulation unit (20) may function in the same manner as the first granulation unit (8), wherein said second granulation unit is arranged for milling, granulating, setting and hardening said granulated mixture from said first granulation unit (8) for the formation of a set, hardened and granulated mixture. This will ensure that the final product is adequately set and hardened in an apparatus having only a small foot-print upon the rig or production vessel. The end section of the first storage tank (15) is defined by the bottom section (17) of the same.

In an embodiment of the invention, the second granulation unit (20) may be provided with second helix shaped transportation slits (21). This may serve a similar purpose as the first helix transportation slits (11), wherein the mixture will be set, hardened and granulated along the path against the covering (19) of the second granulation unit (20). The mixture will be transported to an aperture at the upper portion of the second granulation unit (20), and from here to a second storage tank (22) internal to said second granulation unit (20). In a similar manner as for the first granulation unit (8) the angle of the second granulation unit (20) may be adjusted such that the granulate size may be chosen.

When furnishing material to the second granulation unit (20) a second milling and crushing system (16) may be arranged prior to the outlet from the first granulation unit (8), such that additional crushing and milling is performed before the second granulation, setting and hardening process.

According to an embodiment of the invention the first and second granulation units (8, 20) may be arranged vibrating such that the granulation process is enhanced.

An advantage of using two granulation units (8, 20) is the possibility of controlling the time aspect of the of the treatment process. In this manner it is possible to adapt the process to the mud sieving capacity of the rig or production vessel, and such to avoid production delays. A further advantage of using a two stage granulation is the increased residence time of the cuttings within the unit, due to the increased usage of the reactor volume. As the reactor interior will be hotter than the surroundings, this will allow the setting and hardening process to occur in a speedier manner.

A further advantage of using multiple granulation stages is that one may counteract potential adherence of granulates to each other, or adherence of granulates to each other. This allows the granulate size to be controlled in a better manner.

A further advantage of using multiple granulation stages is the possibility of arranging additive inlets at the second granulation unit (20) as well. One may add water, steam or other additives such as further binder material or the like to the process at this second granulation stage such that additive control is enhanced.

In an embodiment of the invention the two granulation units (8, 20) are arranged mainly vertically, one above the other. This will ensure that material does not need to be transported through the unit, but will mainly move by gravitational action.

According to an embodiment of the invention a second milling unit (16) may be arranged in the first storage tank (15) such that the granulated mixture furnished to the second granulation unit (20) is milled before being fed thereto. There may also be arranged a second intermediate storage area (18) after the first granulation unit (8). From this area (18) the mass may be provided to the second granulation unit (20).

The second storage area (22) may have various shapes according to need. As shown in FIG. 2, the second storage area (22) may be larger than the first storage area (15), and be defined by its walls (26).

In an embodiment of the invention a manifold unit (14) may be arranged such that the first granulation unit (8) and/or the second granulation unit (20) may be furnished with vapour, such that the temperature within the granulation units (8,20) is kept high. This will accelerate the setting and hardening of the mixture within the granulation units, thus ensuring that the setting and hardening is performed in an efficient manner. The temperature may be about 60° C. or above within the apparatus in this embodiment of the invention.

Figure 3:
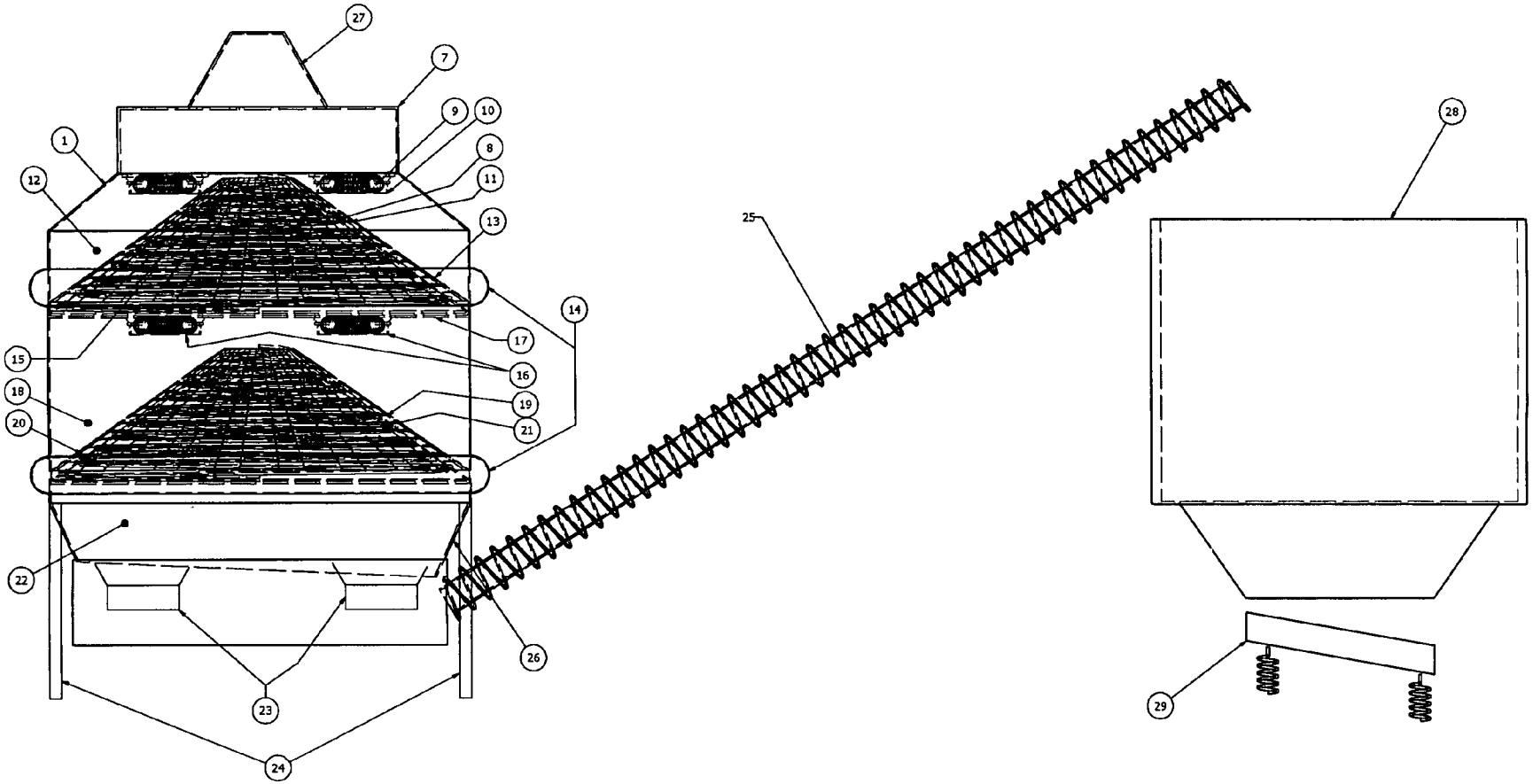
FIG. 3 shows an embodiment of the invention wherein the product of the process is transported for storage in a storage tank.

According to an embodiment of the invention, the second storage area (26) may be provided with an outlet comprising a final milling and crushing unit (23). From this final outlet the granulate may be transported to a storage area (28,29) using transportation unit (25) such as shown in FIG. 3.

As is evident to a person skilled in the art, the first second and final milling units (9, 16, 23) may be adjustable. This allows the operator to set the particle size of granulate.

In an embodiment of the invention chemical compounds known as high molecular polymers are added as additives to the mixture in the mixing unit (7). High molecular polymers presents several advantages when mixed into cement, one of them being that the resulting cement granulate mixture has been shown to be very stable with respect to the leakage of heavy metals or oil compounds. Other additives such as fly ash are known from the background art and should be considered as part of the invention. The additives may furthermore have different functions, one of the most important being to accelerate the setting and hardening of the mixture. These additives for the acceleration of the setting and hardening process are well known in the art.

According to an embodiment of the invention the treatment time using the process described above is reduced to between 2-3 days, a major improvement upon the background art. As the process may be run in a continuous manner, and not solely in batch mode, the treatment capacity of the device according to present invention will be much larger than for current processes.

In an embodiment of the invention, the completed granulated product may either be bagged on board the drilling unit or simply dumped to the ocean. Experimental work has shown the granulate to be stable and environmentally friendly, such that one may easily without ill affects simply deposit the granulate at sea. As the integrated unit according to the invention allows the operator to chose the granulate fraction size, this may chosen such that the granulate will be dispersed by the currents.

Once the finished granulate has been deposited on the seabed, setting and hardening will continue under beneficial conditions on the sea bed. The resulting cement and drill cuttings granulate has been shown to be non-toxic, and growth of algae and other organic compounds on the granulates have been shown to occur freely. This growth will even further reduce potential leakage of harmful compounds in the ocean. It has been shown that the oxygen processes are not disturbed by the presence of the granulated cement and drill cuttings of the present invention.

Although the process according to the present invention envisages dumping of the granulate into the sea, the granulate may easily be bagged and shipped to shore or even stored on the drilling unit if so desired. As the granulate has been stabilised and is an essentially dry product, the handling of the granulate is much simplified with respect to previous drill cutting handling approaches, wherein the wet mass of cuttings, oil and chemicals are bagged and transported to shore in a messy manner. The granulate will continue the hardening and curing process even when stored, thus there is no disadvantage in storing the granulate.

Although the main emphasis of the invention pertains to an integrated unit for use off-shore, it is evident that the unit may be used on land. The advantages of small foot-print, and the production of a stable granulate within a relatively small time span will be of use for land based applications, such as the treatment of environmentally hazardous wastes on shore. These applications are encompassed by the scope of the present invention.

The method according to the invention comprises a method for off-shore treatment of drill cuttings wherein said method comprises the following steps feeding drill cuttings to a mixing unit (7) in an integrated unit (1), measuring the composition of the drill cuttings, feeding binder material, water, steam and/or additives to said mixing unit (7) according to the composition of said drill cuttings, mixing said drill cuttings and added materials within said mixing chamber (7) to form a mixture, feeding said mixture through a mixing outlet (9) to a granulation unit (8), granulating, setting and hardening said mixture in said granulation unit (8), transporting said set and hardened granulated mixture to an outlet for storage or disposal of said set and hardened granulated mixture.

An advantage of the process according to the invention is that the drill cuttings may be treated continuously, and that if needed the drill cuttings will be under constant treatment within the integrated unit (1). The treatment is greatly accelerated when compared to previously known treatment methods. One may consider the method to be an accelerated hydration and hardening process. This acceleration is of major importance when implementing the method according to the invention.

The integrated unit as such may be arranged on adjustable legs (24) or other kinds arrangements. In a similar manner, the unit (28) may be furnished with adjustable arrangements (29) for keeping the unit in position. Further units may be arranged on the integrated unit (1) according to the invention, such as filters (27) and vacuuming units.

Although the above specification describes two granulation units (8,20), it is evident that a plurality of granulation units may be arranged as described above. Thus there may be arranged three, four or more granulation units within the integrated unit as such, and these embodiments should be considered as being within the scope of invention.

Thus there is described a novel integrated unit (1) for the treatment of drill cuttings, wherein the drill cuttings are transformed from being a hazardous waste to a granulate in a single unit in an efficient and speedy manner, wherein the unit (1) has a small footprint and is thus amenable to be installed in off-shore drilling units.

The invention claimed is:

1. An integrated unit for the treatment of drill cuttings, comprising a vertical stack in a cylindrical tank of the following components:

a mixing unit in the upper portion comprising one or more measuring devices for measuring the composition of the wet drill cuttings before being furnished to a wet drill cuttings inlet, a binder inlet, an additive inlet, a water inlet, and a vapour inlet, said mixing unit arranged for mixing the compounds, with a milling and crushing unit for milling the mixture and arranged for feeding to a mixture outlet, wherein one or more dosage units are arranged at said one or more inlets for furnishing the required amount of binder, additive, water and/or vapour respectively for the formation of a desired mixture, said mixing outlet arranged for feeding the mixture down to an underlying first intermediate storage area with a bottom formed by a first conical internal cover arranged for leading said mixture downwards to a peripheral inlet at the rim of an underlying first upwardly tapered granulating unit which is arranged for milling, setting, hardening, granulating and transporting the mixture in an upwardly direction along a first helix path to a central outlet to a first storage tank, said outlet arranged at the upper portion of said first granulation unit, said first storage tank provided with a second outlet, said second outlet arranged for feeding the mixture from said first granulation unit down to an underlying second intermediate storage area with a bottom formed by a second conical internal cover arranged for leading said mixture downwards to a peripheral inlet at the rim of a second conical upwards tapered granulating unit which is arranged for further milling, granulating, setting and hardening and transporting the mixture in an upwardly direction along a second helix path to a central, third outlet arranged at the upper portion of said second granulation unit and leading to a second storage tank, wherein hot vapour is arranged for further being furnished to the unit through manifolds in communication with said first and/or second granulation units, wherein said third outlet is arranged for transporting said set and hardened granulated mixture to an outlet for storage or disposal.

2. An integrated unit according to claim 1 wherein the angle of said first granulation unit is adjustable such that granulate size may be chosen.

3. An integrated unit according to claim 1 wherein the angle of said second granulation unit is adjustable such that granulate size may be chosen.

4. An integrated unit according to claim 1, wherein the unit is installed on an off-shore drilling unit.

* * * * *